United States Patent [19]

Bierhoff et al.

[11] Patent Number: 4,696,590

[45] Date of Patent: Sep. 29, 1987

[54] PRINTER HAVING A GUIDE FOR AN INSERTABLE CASSETTE WHICH CAN HOLD DATA AND TRANSFER STRIPS

[75] Inventors: Waltherus C. J. Bierhoff; Pieter D. Schuitmaker; Cornelis Ouwerkerk; Robertus J. M. Verhoeven, all of Eindhoven, Netherlands

[73] Assignee: U.S. Philips Corporation, New York, N.Y.

[21] Appl. No.: 780,733

[22] Filed: Sep. 26, 1985

[30] Foreign Application Priority Data

May 30, 1985 [NL] Netherlands ..... 8501541

[51] Int. Cl.[4] ..... B41J 11/58

[52] U.S. Cl. ..... 400/613; 400/120; 400/208; 400/234; 400/613.2; 400/618

[58] Field of Search ..... 400/88, 134.5, 134.6, 400/194, 195, 196, 196.1, 207, 208, 208.1, 613, 614, 614.1, 624, 625, 629, 120, 234, 240.3, 240.4, 613.2, 618; 358/75

[56] References Cited

U.S. PATENT DOCUMENTS

| | | | |
|---|---|---|---|
| 2,930,465 | 3/1960 | Lotsch | 400/134.5 |
| 3,255,860 | 6/1966 | Bremer | 400/613 X |
| 3,823,808 | 7/1974 | Murata et al. | 400/613 |
| 4,040,511 | 8/1977 | Beaven, Jr. et al. | 400/88 X |
| 4,161,749 | 7/1979 | Erlichman | 358/75 |
| 4,226,547 | 10/1980 | Bradshaw et al. | 400/613 |
| 4,261,527 | 4/1981 | Sims et al. | 400/196.1 X |
| 4,360,278 | 11/1982 | Paque | 400/613 X |
| 4,409,467 | 10/1983 | Honjo | 400/613.2 X |
| 4,505,603 | 3/1985 | Yana | 400/120 |
| 4,557,617 | 12/1985 | Richardson et al. | 400/613 X |

FOREIGN PATENT DOCUMENTS

| | | | |
|---|---|---|---|
| 0032623 | 3/1980 | Japan | 400/613 |
| 0066988 | 4/1982 | Japan | 400/613.2 |
| 0075880 | 5/1982 | Japan | 400/613.2 |
| 0185674 | 10/1984 | Japan | 400/629 |
| 2100673 | 1/1983 | United Kingdom | 400/240.4 |

*Primary Examiner*—Ernest T. Wright, Jr.
*Attorney, Agent, or Firm*—Robert T. Mayer

[57] ABSTRACT

A printer (1) having a guide (13,15,16) for an insertable cassette (17), which is provided with a data strip (175) displaceable along a printing head (19). In certain arrangements the cassette may also include a transfer strip (177), which could include colored portions. The cassette (17) has an entrance window (167) for a transport roller (65) pivotable in the printer (1) by translation of the cassette (17). During printing, the data strip (175) and the transfer strip (177), if any, are clamped between the printing head (19) on a first cassette side and the transport roller (65) pivoted from a second cassette side located opposite the first cassette side into the entrance window (167). Separate gear wheel trains both driven by the same motor transport the two strips when both are provided.

11 Claims, 19 Drawing Figures

Figure 1:
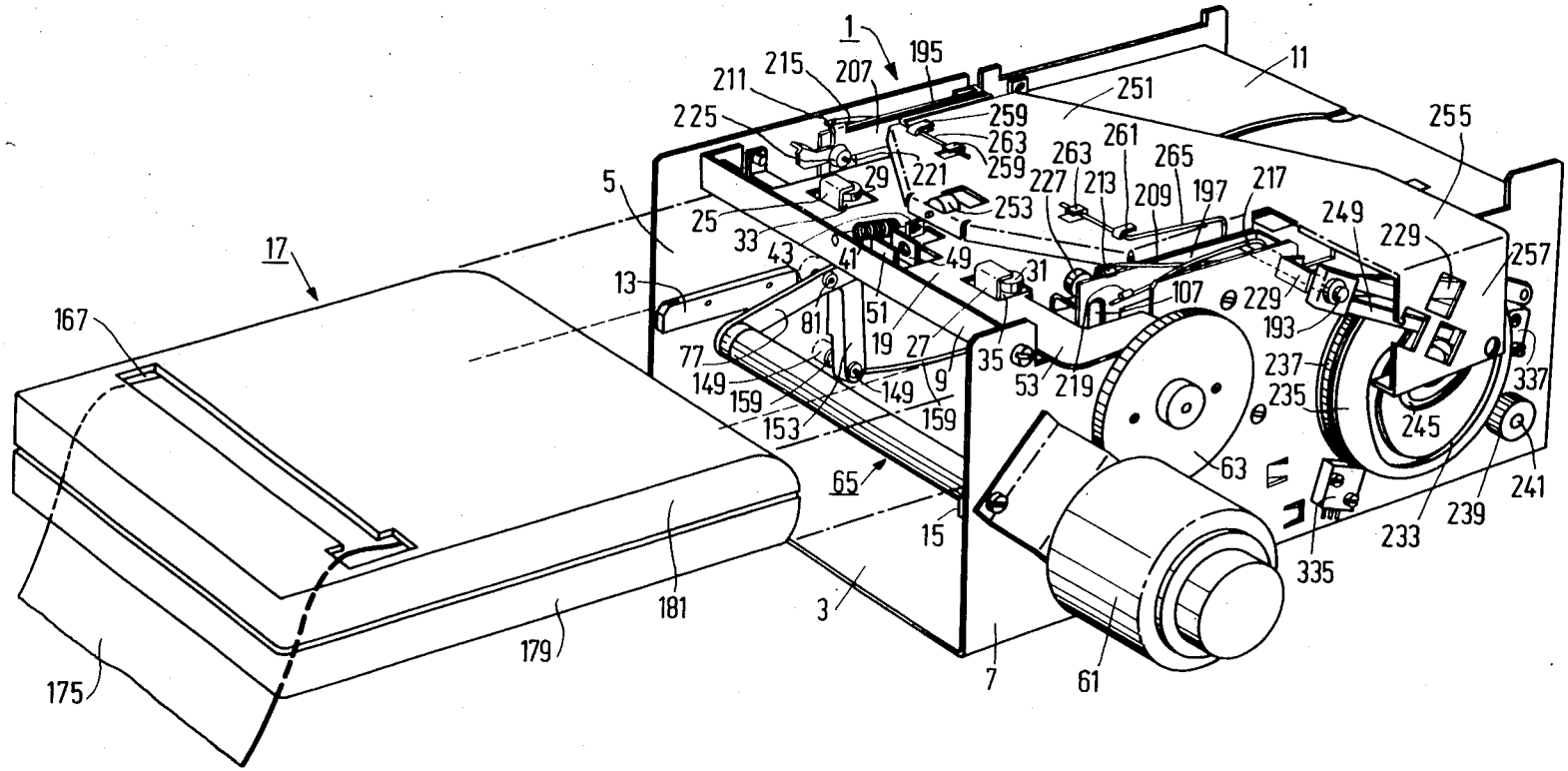

PRINTER HAVING A GUIDE FOR AN INSERTABLE CASSETTE WHICH CAN HOLD DATA AND TRANSFER STRIPS

The invention relates to a printer having a guide for an insertable cassette, in which is provided a receipt strip displaceable with respect to a printing head, the cassette being provided with at least one entrance window for transport members of the said strip.

In a printer of the kind mentioned in the opening paragraph arranged in a video camera (cf. U.S. Pat. No. 4,161,749), the cassette is provided with a curved guide for the receipt or data strip and a colour transfer strip projecting from a supply part. This guide follows the periphery of a transport roller for the receipt strip arranged outside the cassette and extends as far as the area at which the printing head is situated. Before a leaf-shaped receipt strip can be printed, the two strips have to be introduced into the curved guide by means of the manually operated transport members passed into entrance windows of the cassette. Subsequently, the transport of the data strip is taken over by the said transport roller. During printing, the colour transfer strip is situated in a fixed position with respect to the printing head and the transport roller. The known printer for a video camera is a colour printer having a receipt strip and a colour transfer strip on which the different base colours are present.

A disadvantage of the known colour printer is that various transport members are necessary for carrying the colour transfer strip and the data strip outside the cassette for preparing the printing and the transport of the data strip during printing. Furthermore, there is a risk that during transport from the cassette to the curved guide not one, but several data strips are taken along.

The invention has for its object to provide a colour printer suitable both for black-and-white and colour printing, in which the said disadvantages are avoided and by which the transport of the data strip or of the data strip and the colour transfer strip is mechanized to a comparatively great extent.

The invention is for this purpose characterized in that a lock releasable by an initial translation of the cassette in the printer releases a transport roller which is pivotable about a fixed shaft, is cylindrical and performs after a further translation of the cassette a pivotal movement into a cassette window from a first cassette side and consequently gets into pressure contact with the printing head on a second cassette side located opposite the first cassette side, the data strip being clamped during printing between the transport roller and the printing head.

It should be noted that U.S. Pat. No. 4,505,603 corresponding to European Patent Application No. 0086661 discloses a colour printer in which both the transport of the colour transfer strip and that of the data strip take place automatically. The transport mechanism for the strips are fully separated here, however, while the transport does not take place either in a cassette in which both a colour transfer strip and a data strip can be transported. This not only leads to additional transport means, but also results in that the step of introducing the strip is comparatively laborious and must be effected with an opened colour printer.

Furthermore, British Patent Application No. 2100673 discloses a colour printer in which the transport of the colour transfer strip is also fully separated from the transport of the data strip. The transport of the colour transfer strip takes place in the cassette, whereas the transport of the data strip takes place entirely outside the cassette. Also in this case, additional transport means are therefore required.

A particular embodiment of the printer, in which a single electric motor is used for driving a data strip and a transfer strip arranged in the cassette, is further characterized in that the cassette is provided with a data strip and a transfer strip, which, when the transport roller is pivoted, are both clamped between the transport roller and the printing head, while an electric motor arranged in the printer is coupled by way of a first gear wheel train to the transport roller for the transport of the data strip and is coupled by way of a second gear wheel train to a take-up roller for the transport of the transfer strip arranged in the cassette.

A further embodiment of the printer, in which the transfer strip can be transported at an invariably constant speed, is characterized in that a gear wheel belonging to the first gear wheel train is coupled by means of a frictional coupling to a gear wheel belonging to the second gear wheel train.

A still further embodiment of the printer, in which both the position of the cassette with respect to the printing head is defined and a suitable pressure force of the printing head against the data carrier is produced by means of a function disk, is further characterized in that the printer is provided with a rotatable function disk having first and second guide grooves, the first groove being in engagement with a first follower pin which is coupled to a first lever system for pivoting a pair of pressure rollers against the transport roller and for positioning the cassette with respect to the printing head, while the second groove meshes with a second follower pin which is coupled to a second lever system for pivoting a pressure plate engaging the printing head with resilient force.

Another embodiment of the printer, in which the possibility that the symbols to be printed are smeared out is comparatively small, is characterized in that the first and second gear wheel trains are coupled by means of a stepping mechanism to the electric motor.

A preferred embodiment of the printer having a comparatively simple and reliable drive for stepwise transporting the data strip and the data strip and the colour transfer strip, respectively, is further characterized in that the stepping mechanism comprises a first gear wheel which can be continuously rotated by the electric motor and a stepwise rotatable second gear wheel, while the continuously rotatable first gear wheel can be coupled by means of a unidirectional coupling to and can be disengaged from a cam disk which meshes with a cam follower secured to the printing head, the stepwise rotatable second gear wheel being in engagement with a gear wheel which belongs both to the first and to the second gear wheel train.

A preferred embodiment of a cassette for a printer as claimed in claim 1, in which a single electric motor is used for driving the transport roller arranged in the printer and for transporting the transfer strip arranged in the cassette, is characterized in that the cassette has a supply roller for a transfer strip rotatable about a first shaft and a take-up roller for the transfer strip rotatable about a second shaft parallel to the first shaft, the take-up roller being provided with a driving member which can be coupled to an external motor drive arranged in the printer.

A further embodiment of a cassette, in which the transfer strip is permanently kept under tensile stress in a simple manner, is characterized in that the first shaft is provided with a frictional coupling, which during printing, when the first shaft and the second shaft are rotated in a direction corresponding to the transport direction of the data strip or transfer strip exerts a continuous frictional force on the first shaft and after printing, when the second shaft is stationary, causes the first shaft to be transiently rotated in a direction opposite to the direction of rotation of the first shaft during printing.

A still further embodiment of a cassette having a frictional coupling which is comparatively inexpensive in mass production, is characterized in that the frictional coupling comprises a helical spring which is slipped over the first shaft and has a first end bearing on a wall in the cassette and a free second end, a first part of the helical spring engaging on its inner side a part of the first shaft having a comparatively large diameter, while a second part of the helical spring is arranged so as to be free from a part of the first shaft having a comparatively small diameter.

A still further embodiment of the cassette, in which the data strip is protected against undesired transport when the cassette is removed from the printer, is characterized in that the cassette is provided with a brake for the data strip, which during printing is switched off and exerts before and after printing in the switched-on condition a braking force on the data strip.

Figure 2A:
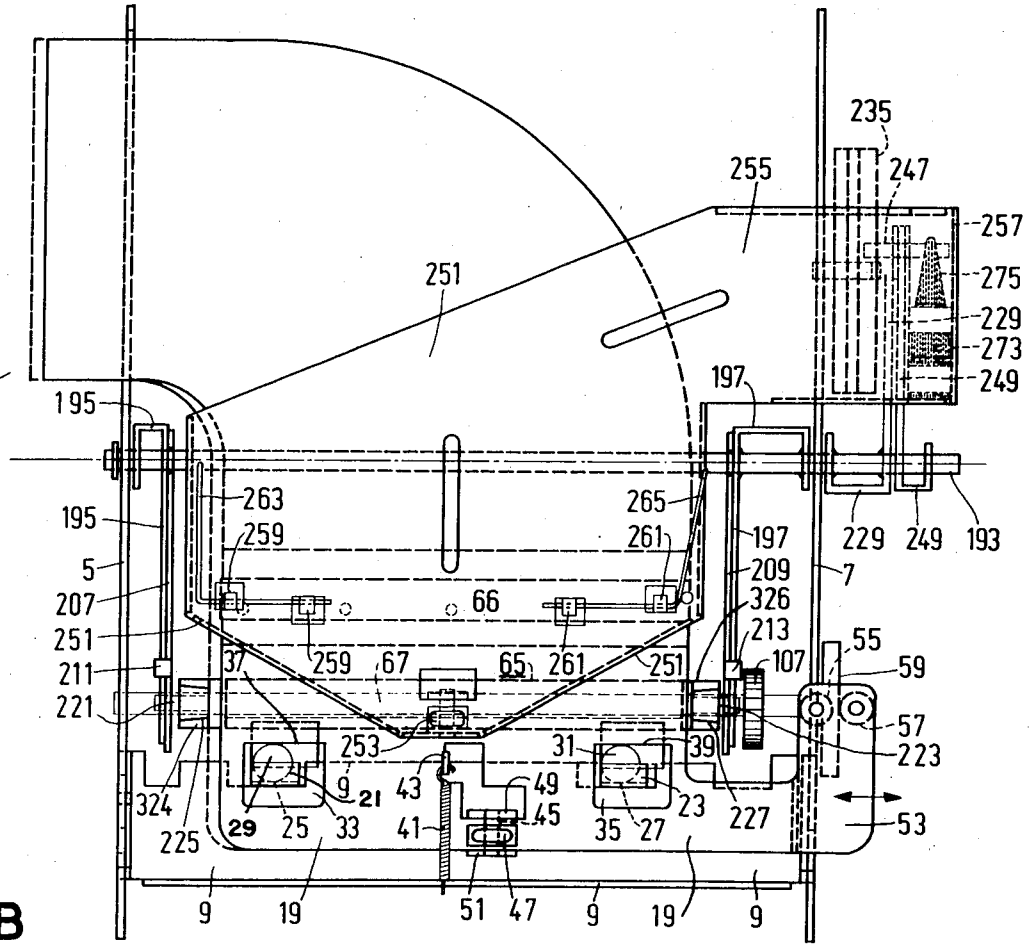
Figure 2B:
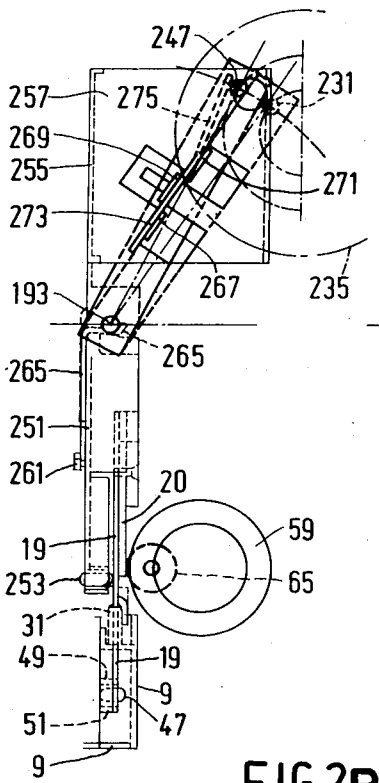
Figure 3:
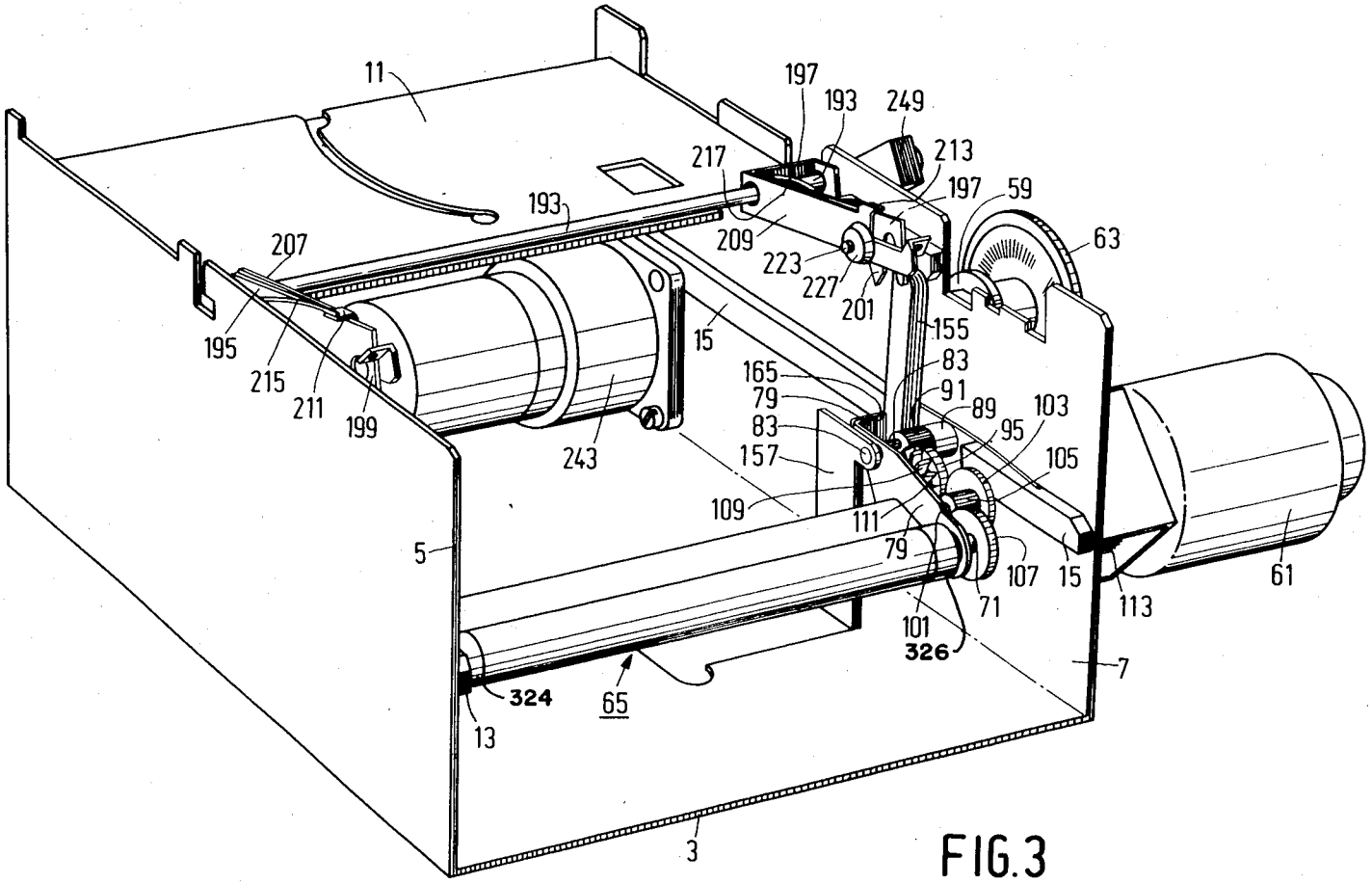
Figure 4:
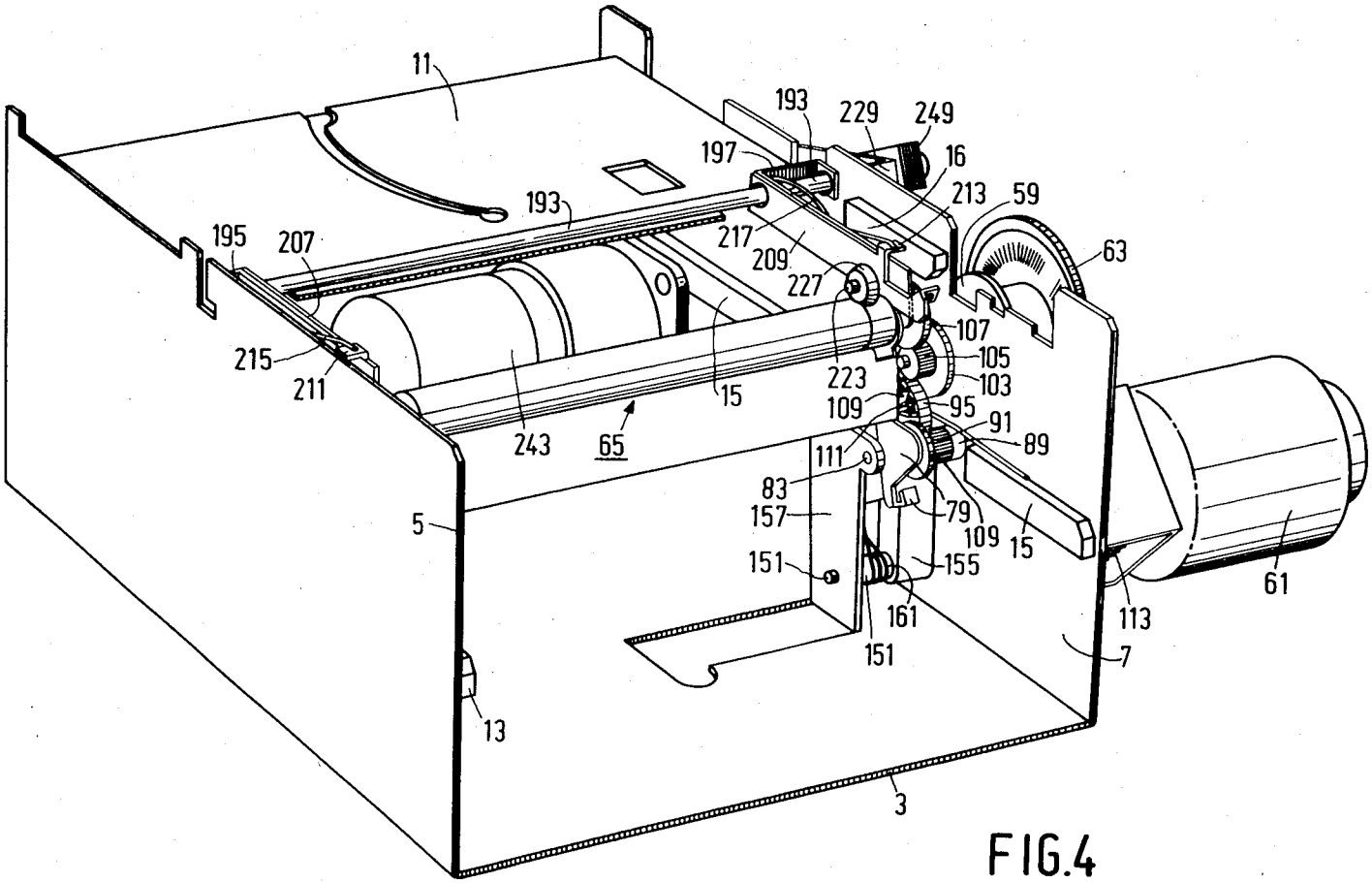
Figure 5:
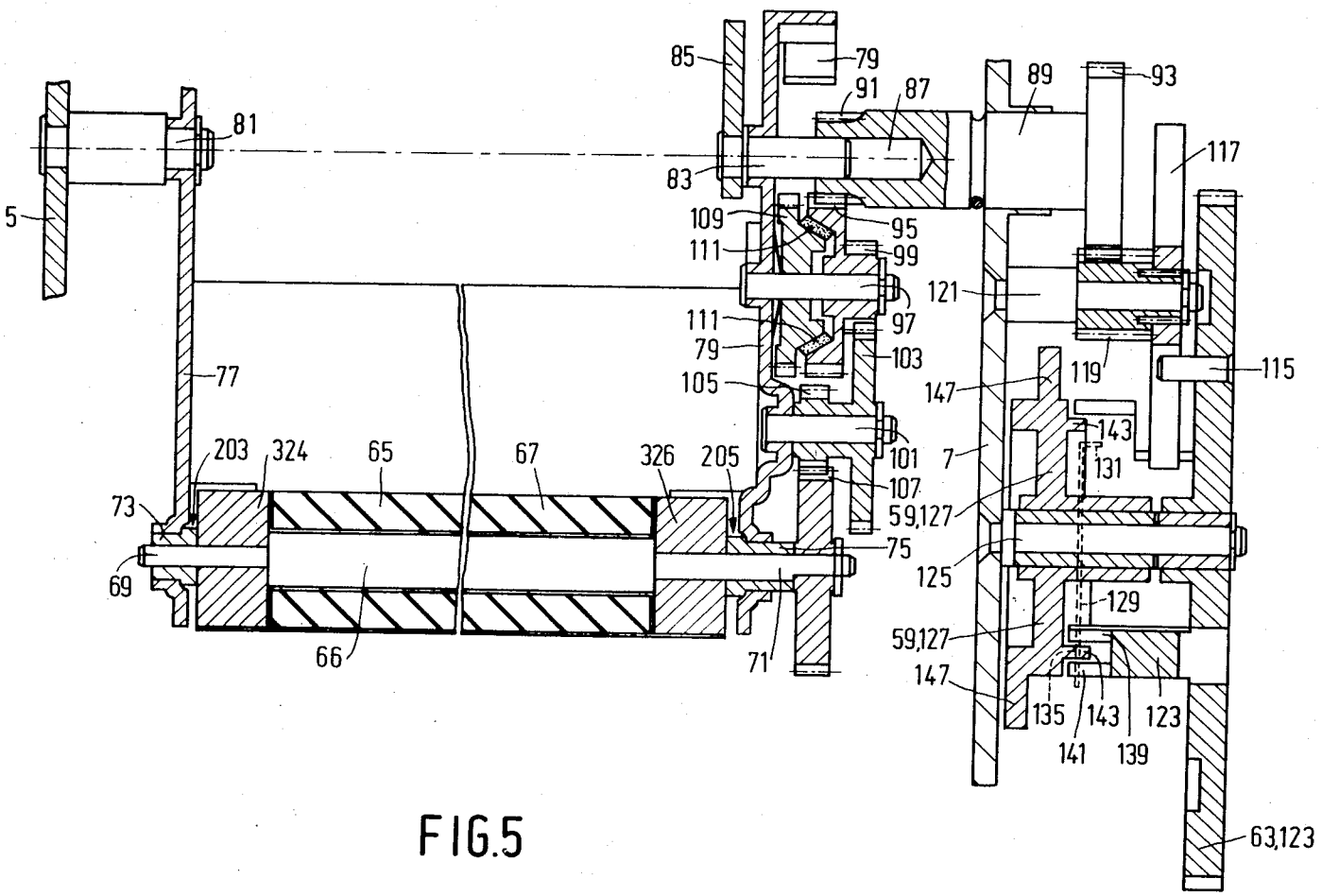
Figure 6:
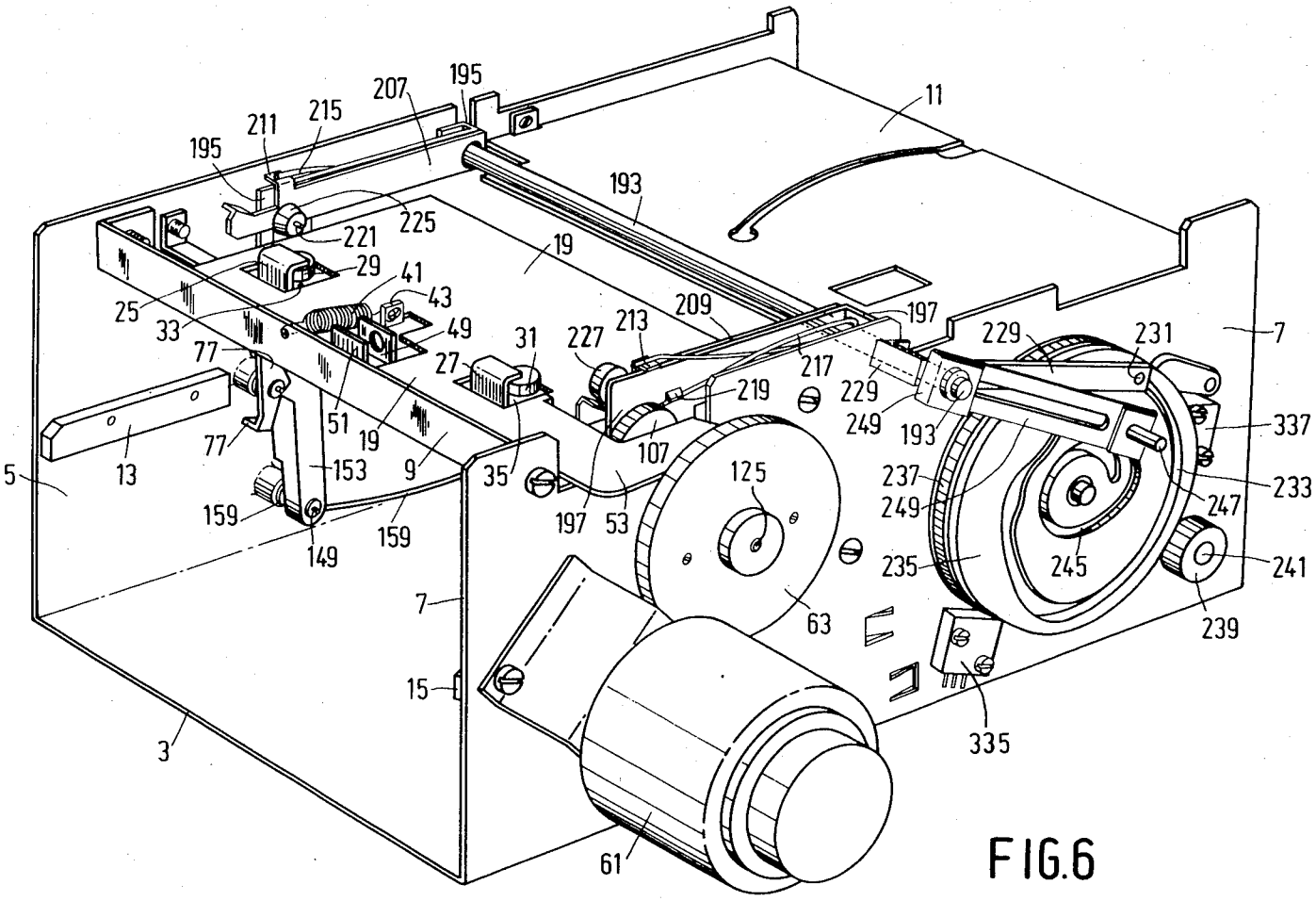
Figure 7:
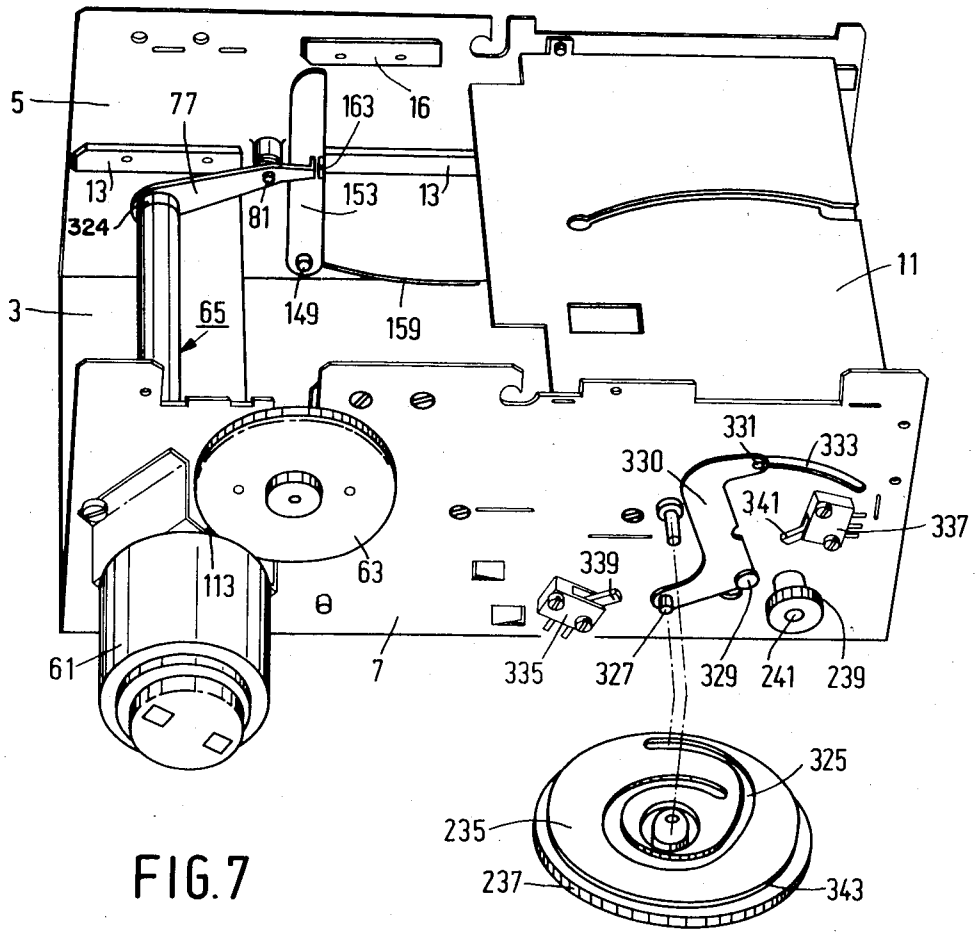
Figures 8, 9:
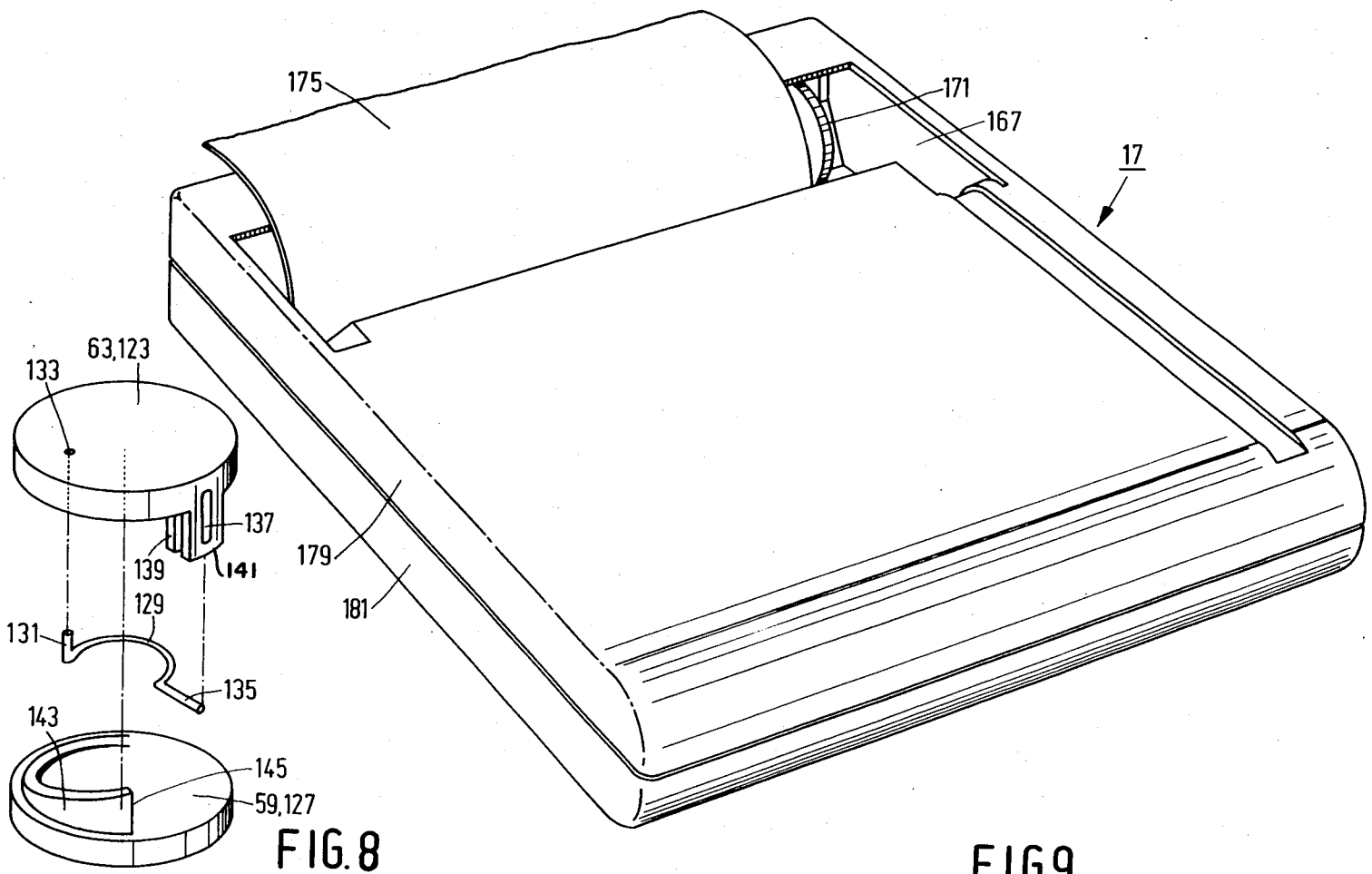
Figure 10:
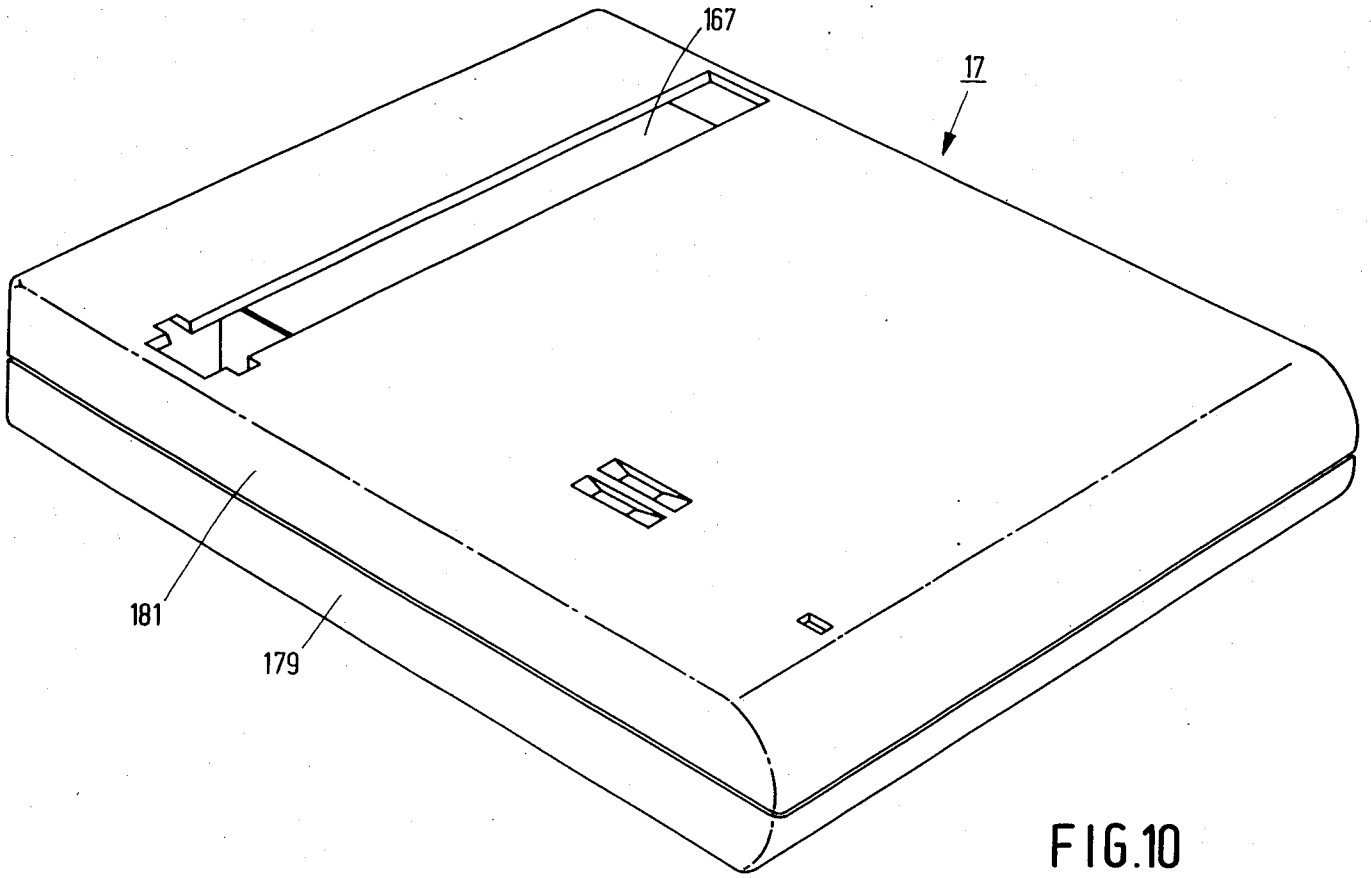
Figure 11:
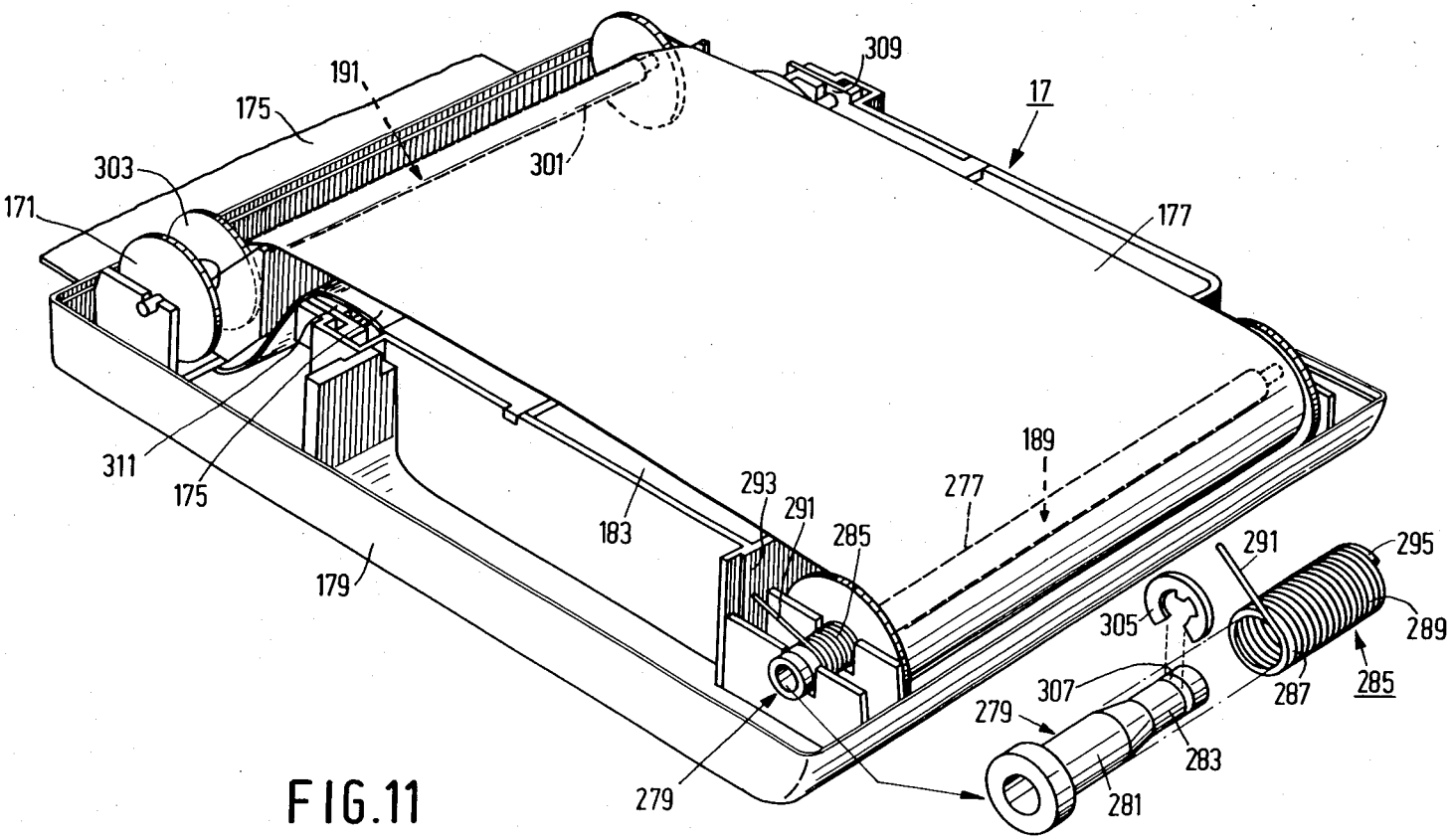
Figure 12:
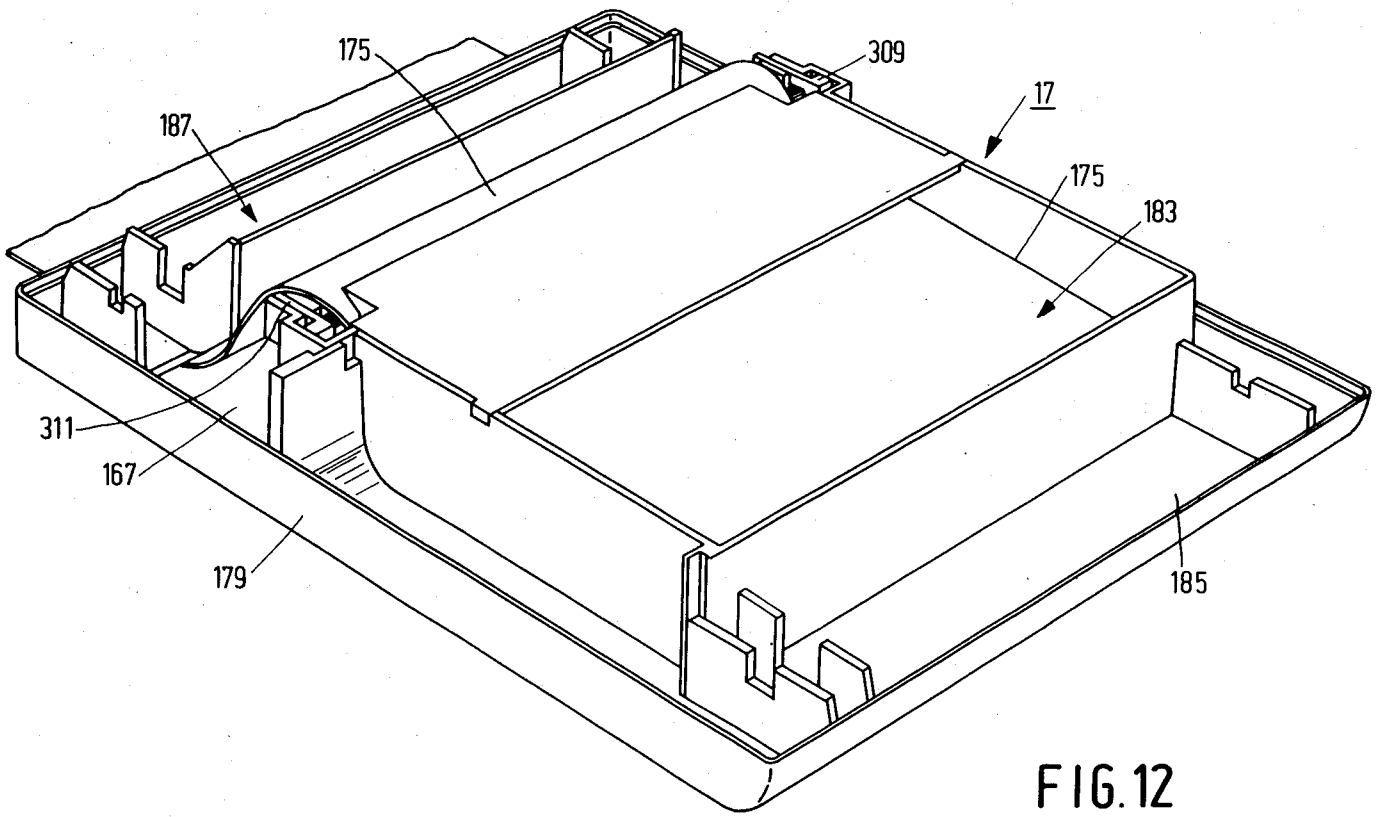
Figure 13:
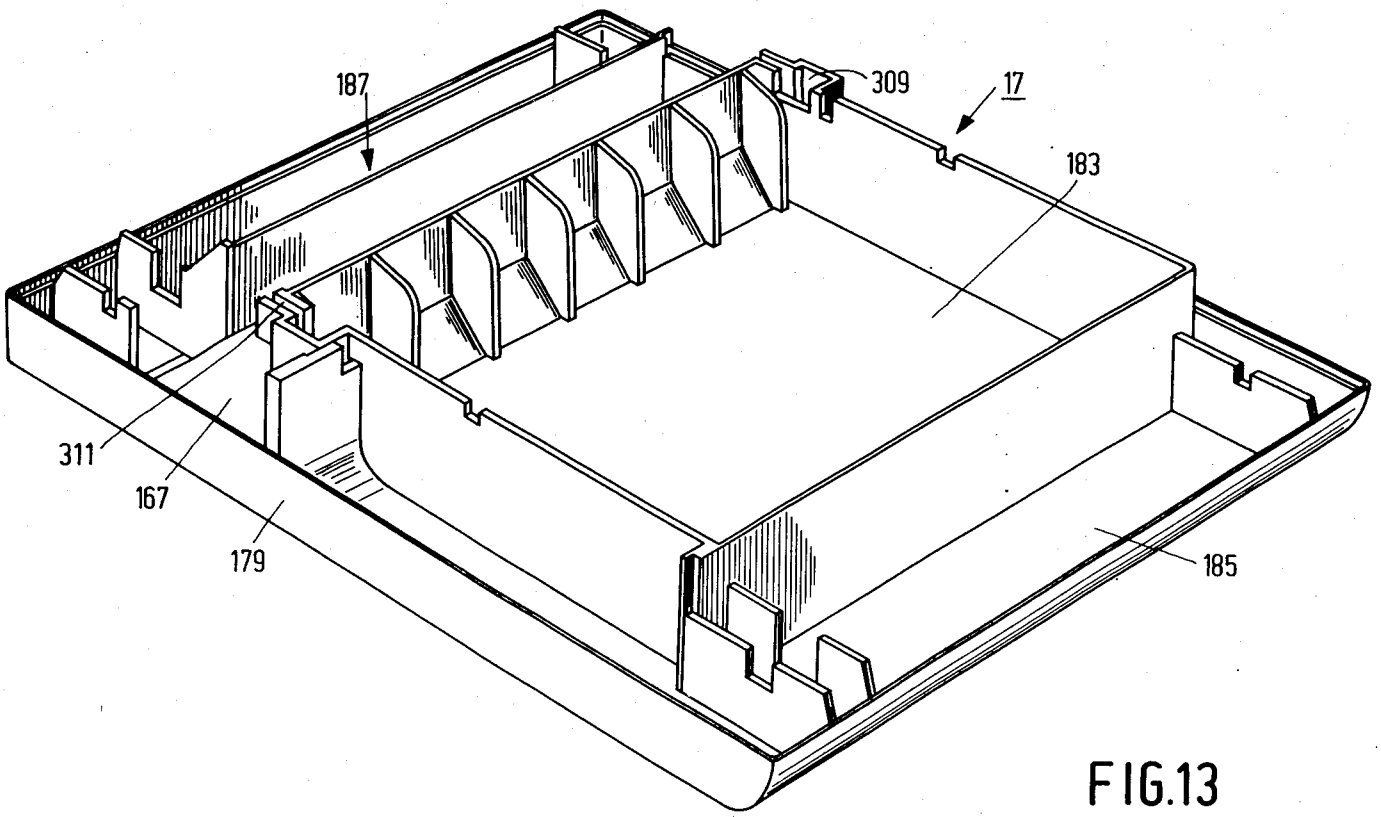
Figure 14:
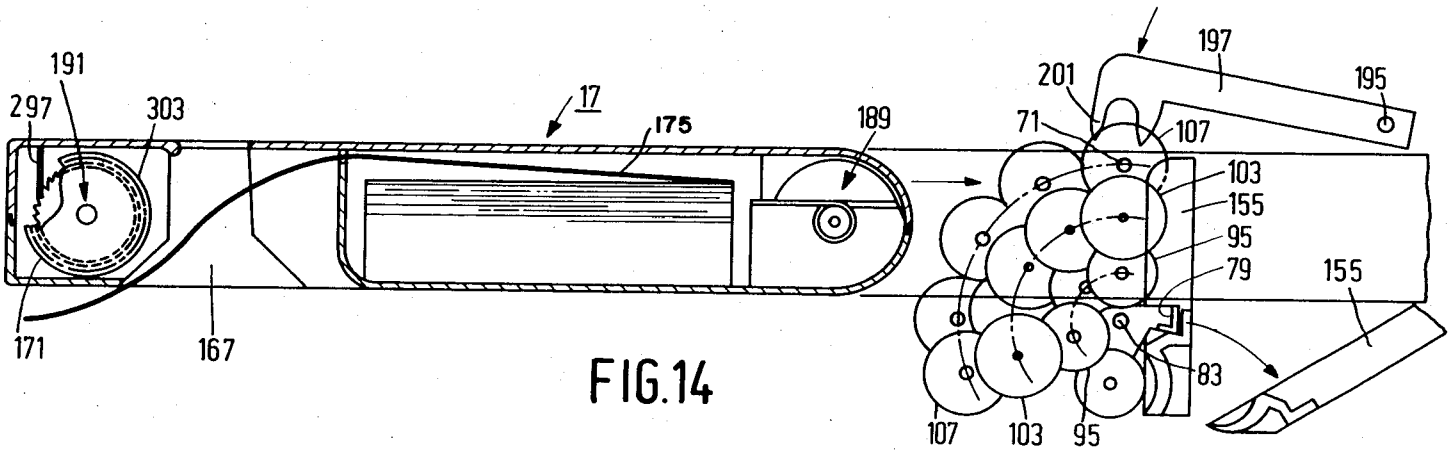
Figure 15:
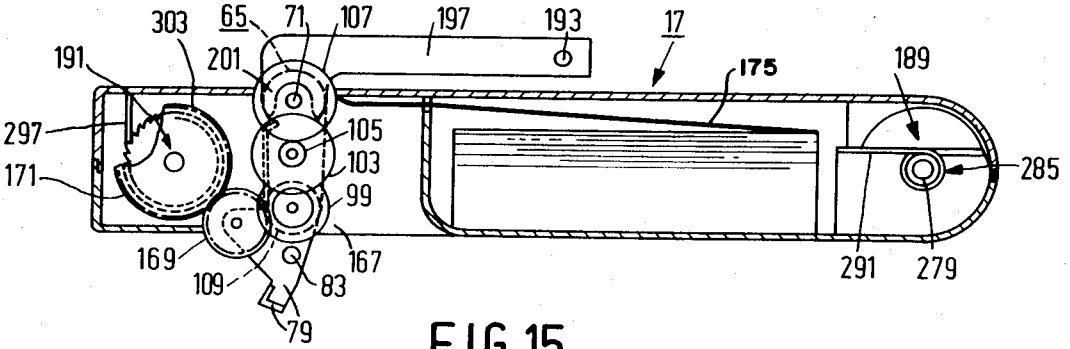
Figure 16:
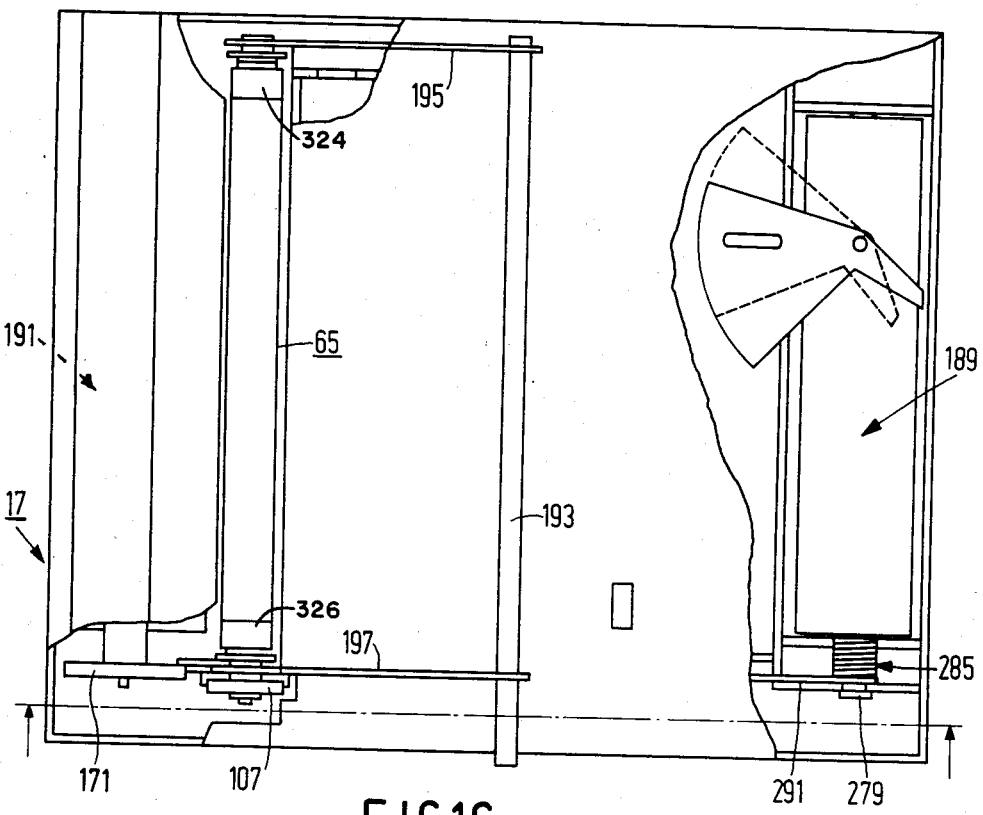
Figure 17:
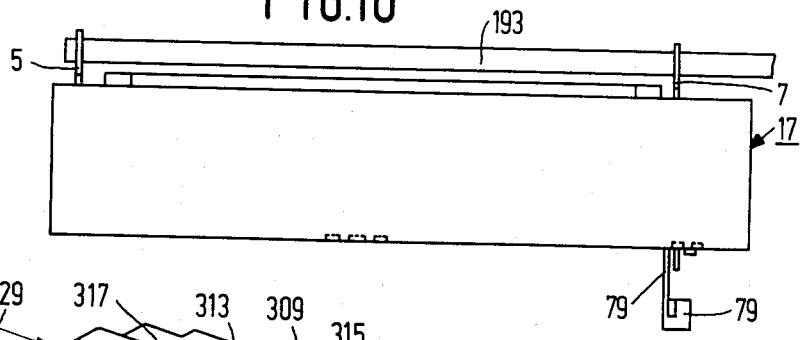
Figure 18:
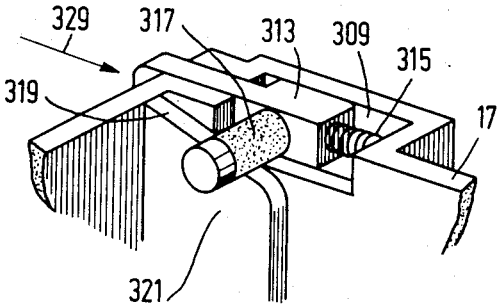

The invention will be described more fully with reference to the drawing, in which:

FIG. 1 is a perspective view of the printer at an instant just before the introduction of the cassette, FIG. 2A is a plan view of the printer shown in FIG. 1, FIG. 2B is a partial side elevation of the printer of FIG. 1, FIG. 3 is a perspective view of a part of the printer shown in FIG. 1 in the condition corresponding to that in which the cassette is removed, FIG. 4 is a perspective view of a part of the printer shown in FIG. 1 in the condition corresponding to that in which the cassette is introduced, FIG. 5 is a sectional view of a part of the printer shown in FIG. 1, FIG. 6 is a perspective view of a part of the printer shown in FIG. 1, FIG. 7 is a perspective view of a part of the printer shown in FIG. 1, the function disk being disassembled, FIG. 8 is a perspective view of the uni-directional coupling for driving the printing head used in a printer shown in FIG. 1, FIG. 9 is a perspective plan view of a cassette used in the printer shown in FIG. 1, FIG. 10 is a perspective bottom view of the cassette shown in FIG. 9, FIG. 11 is a perspective plan view of a cassette shown in FIG. 9 partly disassembled, FIG. 12 is a perspective plan view of a cassette shown in FIG. 9 partly disassembled, FIG. 13 is a perspective plan view of a cassette shown in FIG. 9 partly disassembled, FIG. 14 is a longitudinal sectional view of the cassette shown in FIG. 9 just before being positioned in the printer, FIG. 15 is a longitudinal sectional view of the cassette shown in FIG. 9 after being positioned in the printer, FIG. 16 is a plan view of the cassette shown in FIG. 15, FIG. 17 is a front elevation of the cassette shown in FIG. 15, FIG. 18 is a perspective view of a portion of the cassette of FIG. 15.

The preferred embodiment of a printer 1 is shown in FIG. 1. The printer 1 comprises a housing with a bottom 3 and two parallel sidewalls 5 and 7 arranged at right angles to the bottom 3. For strengthening the housing, the sidewalls 5 and 7 are interconnected by means of a connection rod 9 (FIG. 2A) and a connection plate 11. To the sidewalls 5 and 7 are secured parallel horizontal rails 13, 15 and 16 (cf. FIGS. 4 and 7) for guiding a cassette 17. The plate-shaped cassette 17 can be fully inserted into the housing of the printer 1 over the rails 13, 15 and 16. As appears from FIGS. 1 and 2A and 2B, the printer 1 is provided with a printing head 19 which is movable in a reciprocating manner in a horizontal plane in a direction at right angles to the direction of insertion of the cassette 17. The plate-shaped printing head 19 has on its lower side a row of known thermal printing elements 20 (shown in the side elevation of FIG. 2B), which have to be brought into pressure contact with colour transfer strip 177 (FIG. 11) and the data carrier or strip 175, which will be explained more fully hereinafter. On the connection rod 9 of L-shaped cross-section are formed two L-shaped lugs 21 and 23, whose upright walls 25 and 27 lying in a vertical plane form a guide for two loose disk-shaped rollers 29 and 31. The printing head 19 is provided with two rectangular windows 33 and 35 having edges 37 and 39 which also form a guide for the rollers 29 and 31. By means of a tensile spring 41, which is hooked at one end into the connection rod 9 and at its other end into a lug 43 on the printing head 19, the rollers 29 and 31 are kept pressed against the wall 25 and the edge 37, and against the wall 27 and the edge 39, respectively. A third roller 47 is secured on a shaft 45 which is rotatably journalled in two lugs 49 and 51, which are formed on the printing head 19 (cf. FIG. 2B). The third roller 47 is guided during printing on the horizontal surface of the L-shaped connection rod 9. On a flap 53 of the printing head 19 are journalled two rotatable rollers 55 and 57, which serve as cam followers. The cam followers 55 and 57 roll off over a rotable cam disk 59, which is driven by means of a D.C. motor 61 by way of a gear wheel 63 (FIG. 1). The drive of the cam disk 59 will be explained more fully hereinafter with reference to FIGS. 1, 2, 5, 7 and 8.

As shown in FIG. 5, the printer 1 is provided with a cylindrical transport roller 65 having a rubber sheath 67 freely rotatable about a core 66. The longitudinal axis of the transport roller 65 lies in a horizontal plane and extends in a direction at right angles to the transport direction of the cassette 17 (FIG. 1). By means of stub shafts 69 and 71, which form part of the core 66, and bearings 73 and 75, the transport roller 65 is rotatably supported in levers 77 and 79. The lever 77 is rotatable about a shaft 81, which is secured in the sidewall 5, while the lever 79 is rotatable about a shaft 83 which is secured in a frame plate 85. The shaft 83 is inserted into a bore 87 of a comparatively thick shaft 89, on which is formed at one end a toothing or gear wheel 91 and at the other end a toothing or gear wheel 93. The shaft 89 is rotatably journalled in the sidewall 7 and can also rotate about the shaft 83. The gear wheel 91 meshes with a gear wheel 95, which is rotatable about a shaft 97 secured in the lever 79, and is integral with a further gear wheel 99 which is also rotatable about the shaft 97. A gear wheel 103, which meshes with the gear wheel 99, is rotatable about a shaft 101 secured in the lever 79. A gear wheel 105 is integral with the gear wheel 103 and rotates together with it about the shaft 101. The gear wheel 105 meshes with a gear wheel 107 fixedly secured on the stub shaft 71. A gear wheel 109 is also rotatable about the shaft 97 and this gear wheel 109 is driven by the gear wheel 95 by way of a frictional coupling in the form of a ring 111, which is made of a material having a compararively high frictional coefficient, such as a polyester elastomer.

On the output shaft (not shown) of the motor 61 is arranged a pinion 113 (cf. FIGS. 3 and 4) which meshes with the gear wheel 63 (cf. FIGS. 1, 5 and 6). As appears from FIG. 5, the gear wheel 63 is provided with a pin 115, by means of which a known Maltese cross 117 is driven in a stepwise manner. On the Maltese cross 117 is secured a gear wheel 119, which rotates together with the Maltese cross 117 in a stepwise manner about a shaft 121 mounted in the sidewall 7. Furthermore, the gear wheel 63 is coupled by means of a freewheel coupling to the cam disk 59. The gear wheel 119 meshes with the gear wheel 93. The freewheel coupling shown diagrammatically in FIG. 8 comprises a first coupling half 123 integral with the gear wheel 63 and a second coupling half 127 which is rotatable about a shaft 125 (FIG. 5) secured in the sidewall 7 and is integral with the cam disk 59. The freewheel coupling further comprises a wire spring 129 (FIG. 8) having a first rectangularly bent end 131 which is inserted into a hole 133 in the first coupling half 123 and a second rectangularly bent end 135 which is inserted through two slotted holes 137 (only one slotted hole 137 is shown in FIG. 8), which are formed in lugs 139 and 141 (FIG. 5). The lugs 139 and 141 are at right angles to the plane of the first coupling half 123 and limit a gap in which a comb or ridge 143 extends, which is formed on the second coupling half 127. Upon rotation of the first coupling half 123 is the freewheel direction, the end 135 of the spring 129 follows the comb 143 from a given instant. The spring 129 is then stretched when the end 135 is simultaneously displaced in the slotted holes 137. Upon further rotation of the first coupling half 123, the end 135 of the spring 129 falls behind a shoulder 145 formed on the comb 143 and the spring 129 is relieved. When the direction of rotation of the first coupling half 123 is then reversed (reverse direction), the end 135 of the spring 129 will engage the shoulder 145 and take along the second coupling half 127 and hence the cam disk 59 in the reverse direction. The cam disk 59 is provided with a comb or ridge 147 (FIG. 5), which can be described mathematically with a so-called polynomial of the fifth order. The rollers 55, 57 (cf. FIG. 2A) follow the comb 147 so that a reciprocating translation movement is imposed on the printing head 19.

The transport roller 65 has two final positions, that is, a first final position in which the cassette 17 is removed and a second final position in which the cassette 17 is inserted. In the first final position, the transport roller 65 is locked in a position lying below the guiding level of the rails 13 and 15, as is apparent from FIGS. 1, 3, and 14. The transport roller 65 is locked by means of a lock which can releasably be locked over the rails 13 and 15 by an initial translation of the cassette 17, which lock comprises two levers 153 and 155 rotatable about shafts 149 and 151, respectively (cf. also FIGS. 4, 6, 7). The shaft 149 is journalled in the sidewall 5 (FIGS. 1, 6 and 7), while the shaft 151 is journalled in a lug 157 which is stamped out of the bottom 3 (cf. FIGS. 3 and 4). The levers 153 and 155 are pre-stressed by wire springs 159 and 161 wound around the shafts 149 (FIG. 1) and 151 (FIG. 4), respectively. For this purpose, the ends of the springs 159 and 161 are hooked on the one hand into the sidewall 5 and the lug 157 and on the other hand into the levers 153 and 155 respectively. The pre-stress direction is chosen so that in the first final position of the levers 153 and 155 lugs 163 and 165 formed on the levers 153 and 155 are pressed against the levers 77 and 79 (see FIGS. 3, 6 and 7). The levers 77 and 79 carrying the transport roller 65 are pre-stressed in the same manner as the levers 153 and 155. In this case, the pre-stress force of the respective wire springs is directed so that, after being released by the cassette 17, the transport roller 65 is pivoted upwards with the levers 77 and 79. It should be noted that the pre-stress moments of the levers 153 and 155 at the area of engagement with the levers 77 and 79 must be larger than the pre-stress moments of the levers 77 and 79 in the case in which the pressure points are located above or below the shafts 81 and 83 (see FIGS. 3 and 7). In the embodiment described, these pressure points are at the same vertical level as the shafts 81 and 83 so that the ratio of the pre-stress forces is not critical. As appears from FIGS. 3 and 14, the levers 153 and 155 are pressed backwards, in the case of an initial translation of the cassette 17 in the printer 1, against the resilient force in the printer 1 over the rails 13 and 15 by the front side of the cassette 17 so that the locking of the levers 77 and 79 is released. The levers 77 and 79 are now pivoted under resilient force with the transport roller 65 upwards. The cassette 17 is provided with a funnel-shaped cassette window 167 (FIG. 1), which, when the translation of the cassette 17 continues, lies just above the transport roller 65 when the latter reaches the level of the rails 13 and 15. The levers 77 and 79 are now automatically pivoted into the position shown in FIG. 15, in which the transport roller 65 projects just above the cassette 17. In this position, a gear wheel 169, which is in engagement with the gear wheel 109, becomes engaged with a gear wheel 171 which is present in the cassette 17 and is coupled to a take-up roller 191 for the colour transfer strip 177. The gear wheel 171 is shown in FIGS. 9, 11, 14, 15 and 16, while the gear wheel 169 is shown only in FIG. 15. The gear wheel 169 is rotatably journalled on the lever 79.

In the present case, the cassette 17 is provided with a data strip 175 (FIG. 11) (normal paper) and a colour transfer strip 177. Those skilled in the art will understand from the aforementioned British reference 2100673 but it is mentioned herein anyway by way of example that although not shown as such colour transfer strip 177 could be of a usual kind comprising three fields (not shown) of wax of different body colours, that is yellow, magenta and cyan, for each colour image. As those skilled in the art will also understand but as a further example it is also mentioned that as shown in U.S. Pat. No. 4,505,603 a fourth field (not shown) of wax in the colour black could be present for each colour image to be produced. The cassette 17 made of a synthetic material has a lower half 179 and an upper half 181 (FIG. 10), which are snap-connected to each other. As appears from FIGS. 12 and 13, the lower half 179 is provided with three compartments 183, 185 and 187. The compartment 183 accommodates the telescopically folded paper or data strip 175 one end of which is passed through the cassette window 167 outside the cassette 17. The compartment 185 is provided with a supply roller 189, onto which the colour transfer strip 177 is wound (cf. FIG. 11). The colour transfer strip 177 is wound onto the take-up roller 191, which is located in the compartment 187 and is guided in a horizontal track near the upper side of the cassette window 167. The colour transfer strip 177 is kept taut both before and during printing in a manner to be described more fully. When the transport roller 65 is pivoted to the position shown in FIG. 15, both the paper 175 and the colour transfer strip 177 are pushed outside the cassette 17 and are stretched around the transport roller 65.

The transport roller 65 is now locked against displacement parallel to the direction of insertion of the cassette 17 in the final position occupied during printing by means of a first driven lever system. This first lever system comprises two levers 195 and 197 secured to a rotatable shaft 193 journalled in the sidewalls 5 and 7 (cf. FIGS. 1, 2, 4, 6 and 14). The levers 195 and 197 are provided at their ends remote from the shaft 193 with forks 199 and 201 (cf. FIG. 3). The forks 199 and 201 grip with tight fit around the bearings 73 and 75 at the area of the reference numerals 203 and 205 in FIG. 5. Furthermore, the levers 195 and 197 are provided with arms 207 and 209 (FIG. 2A) which are rotatable about the shaft 193. The arms 207 and 209 are provided with lugs 211 and 213 which project beyond the levers 195 and 197 and on which bears an end of wire springs 215 and 217 (FIG. 6) wrapped around the shaft 193. The other end of the pre-stressed wire springs 215 and 217 is hooked under a projection on the levers 195 and 197. Such a projection 219 of the lever 197 is shown in FIG. 6. The arms 207 and 209 have secured to them stub shafts 221 and 223 (FIG. 2B) on which are journalled rotatable conical pressure rollers 225 and 227. The outer side of the forks 199 and 201 accurately fits into the upper side of the cassette window 167 so that the cassette 17 with the forks 199 and 201 can also be positioned and fixed. As appears from FIGS. 1, 2 and 6, the pivotal movement of the levers 195 and 197 and hence also of the arms 207 and 209 is obtained by rotating the shaft 193. For this purpose, the shaft 193 has secured to it a lever 229 which is provided with a follower pin 231 (cf. FIG. 6). The follower pin 231 extends in a groove 233 of a function disk 235 rotatably journalled in the sidewall 7. The function disk 235 is provided with a toothing 237, which is engaged by a pinion 239 which is driven by a shaft 241 coupled to a D.C. motor 243 arranged in the printer 1 (cf. FIG. 3). Upon rotation of the function disk 235 in the correct direction, the levers 195 and 197 and the arms 207 and 209 are pivoted in the direction of the transport roller 65 located near the second final position. The pivotal movement of the arms 207 and 209 terminates at the instant at which the pressure rollers 225 and 227 engage with a predetermined force the data strip 175 which is stretched around the transport roller 65 and which is wider than the colour transfer strip 177. The pivotal movement of the levers 195 and 197 is then continued with stationary arms 207 and 209 until the forks 199 and 201 surround with tight fit the bearings 73 and 75. At that instant, the cassette 17 is also fixed by the outer side of the forks 199 and 201. During the relative movement then occurring between the levers 195 and 197 and the arms 207 and 209, the wire springs 215 and 217 are further stretched.

As appears from FIGS. 1 and 6, the function disk 235 is further provided with a second groove 245 in which one end of a second follower pin 24 (FIG. 6) is guided. The second follower pin 247 forms part of a second lever system comprising a lever 249 which is rotatable about the shaft 193. A pressure plate 251 (FIG. 1) which is located above the printing head 19 and in which a pressure roller 253 is rotatably journalled has a laterally directed flap 255 and a downwardly directed flap 257 (FIG. 2A). The pressure plate 251 is rotatable about the shaft 193 and is locked against displacement in a direction parallel to the direction of insertion of the cassette 17 by means of two wire springs 263 and 265 supported by the shaft 193 and by lugs 259 and 261. The downwardly directed flap 257 is provided with three stamped lugs 267, 269 and 271 (FIG. 2B) between which is arranged a leaf spring 273. A tapering end 275 (FIG. 2A) of the leaf spring 273 resiliently engages the follower pin 247. When the function disk 235 is rotated, the point of engagement between the follower pin 247 and the leaf spring 273 is displaced, as a result of which the pressure plate 251 performs a pivotal movement directed towards the printing head 19. The pressure roller 253 then engages the printing head 19 with the force required for printing. The printing head 19 is therefore pressed with the desired force against the colour transfer strip 177 surrounding the transport roller 65.

Both when the cassette 17 is located outside the printer 1 and when the cassette 17 is inserted into the printer 1, the colour transfer strip 177 is kept taut by means of a frictional coupling. For this purpose, a short shaft 279 (FIG. 11) is secured to a shaft 277 of the supply roller 189 (cf. FIG. 11) in any suitable manner. The shaft 279 has a part 281 of a comparatively large diameter and a part 283 of a comparatively small diameter. The shaft 279 is surrounded by a helical spring 285 having a diameter which is constant throughout its length in the relieved state. The helical spring 285 is slipped in the relieved state with a loose sliding fit over the comparatively thick part 281 of the shaft 279 and is arranged so as to be free from the comparatively thin part 283. When during printing a pulling force is exerted by the transport roller 65 on the colour transfer strip 177, a part 287 of the spring 285 is effectively wound onto the part 281 of the shaft 279, as a result of which a loose clamping fit is obtained between the part 281 of the shaft 279 and the part 287 of the spring 285. The diameter of the part 287 of the spring 285 is consequently slightly reduced, while the diameter of a part 289 of the spring 285 arranged freely around the part 283 of the shaft 279 remains constant. During stretching of the part 287 of the spring 285, one end 291 thereof engages a wall 293 of the cassette 17. The other end 295 of the spring 285 remains free. When the part 287 of the spring 285 is stretched, the latter exerts a frictional force on the part 281 of the shaft 279 so that a constant braking force is exerted on the supply roller 189 and the colour transfer strip 177 is kept taut. When the rotation of the transport roller 65 is then stopped and the cassette 17 is removed from the printer 1, the relieving force in the spring 285 is sufficient to tighten the bulge produced by the transport roller 65 in the colour transfer strip 177. The take-up roller 191 is locked against backward rotation by a leaf spring 297 arranged in the cassette 17 (cf. FIGS. 14 and 15), which is in engagement with the teeth of a milled wheel 303 mounted on a shaft 301

(FIG. 11) of the take-up roller 191. The spring 285 is locked against displacement over the shaft 279 by a locking spring 305, which is located in a groove 307 of the shaft 279. There are formed in the lower half 179 (FIG. 13) of the cassette 17 on either side of chambers 309 and 311 in which a brake is provided for the data strip 175 which is wider than the colour transfer strip 177 (cf. FIGS. 11, 12 and 13). The operation of the brake provided in the chamber 309 is described with reference to FIG. 18. The brake for the chamber 311 is identical to that for the chamber 309. The chamber 309 accommodates a slide 313 which is displaceable against the force of a spring 315, which, when the cassette 17 is removed from the printer 1, is unloaded. The slide 313 is guided along the walls of the chamber 309. The slide 313 has secured to it a rubber-coated pin 317 which is guided along a slope 319 of a partition wall 321 in the cassette 17. The forks 199 and 201 (FIG. 3) at the ends of the levers 195 and 197 are proportioned so that their back side presses, after a pivotal movement of the levers 195 and 197, against the slide 313 in the direction of an arrow 329 in FIG. 18. The pin 317 then occupies its lowermost position on the slope 319 so that the data strip 175 is free from the pin 317 during printing. When the cassette 17 is removed from the printer 1, the spring 315 is relieved so that the pin 317 will occupy its uppermost position on the slope 319. In the latter position, the pin 317 presses the data strip 175 against the lower side of the upper half 181 of the cassette 17 and then acts as a brake. Thus, the data strip 175 is prevented from being unintentionally displaced by exerting a pulling force on the part projecting from the cassette 17. The data strip 175 in fact continuously projects by a part from the cassette 17 through the cassette window 167. Due to the braking force on the data strip 175, this strip 175 can also be torn off in a simple manner.

It should be noted that the forks 199 and 201 have a threefold function, that is positioning the cassette 17 with respect to the printing head 19, positioning the transport roller 65 with respect to the printing head 19, switching off the brake on the data strip 175.

The operation of the printer 1 will be described below, it being assumed that the cassette 17 is introduced and positioned by the forks 199 and 201 and that the pressure plate 251 keeps the printing head 19 pressed against the data strip 175 and colour transfer strip 177 arranged to surround the transport roller 65. By way of the pinion 113, the gear wheel 63 and the coupling half 123 integral therewith are driven by the motor 61. It is assumed that the direction of rotation of the gear wheel 63 is such that the spring 129 (FIG. 8) is pressed against the shoulder 145 of the comb 143 on the coupling half 127, as a result of which the cam disk 59 integral therewith is set into rotation. The rollers 55 and 57 rotatably journalled on the printing head 19 then roll off over the comb 147 of the cam disk 59 so that a reciprocating translatory movement is imposed on the printing head 19, which with friction slips over the colour transfer strip 177 with its row of printing elements 20. During the reciprocating translatory movement of the printing head 19, the colour transfer strip 177 and the data strip 175 are stationary, which will appear from the following part of the description. The transport of the data strip 175 and of the colour transfer strip 177 in fact takes place intermittently. The pressure rollers 225 and 227 press the data strip 175 at the sides against two disks 324 and 326 which are secured on the stub shafts 69 and 71 and which are provided with a rough frictional surface and in the first instance bring about the transport of the data strip 175. The data strip 175 is kept taut in the direction of width due to the fact that the pressure rollers 225 and 227 are conical. The colour transfer strip 177 is transported by the take-up roller 191 in the cassette 17 and has a width which is not larger than the width of the rubber sheath 67 rotatable about the core 66. The sheath 67 consequently does not fulfil a transport function, but serves to press the two strips (175, 177) against the printing elements 20. In the second instance, the transport of the data strip 175 is obtained by the frictional force exerted by the colour transfer strip 177 on the data strip 175. When in a usual manner the thermal printing elements 20 on the printing head 19 are energized, a row of points of the image to be formed is printed on the data carrier 175 during the first forward stroke of the printing head 19. As will be understood by those skilled in the art, if it is assumed that a three color print is to be printed the image points of the first row could have a yellow colour which would be formed by remelting a small quantity of yellow wax from a rectangular field of yellow wax on the lower side of the colour transfer strip 177. After the printing head 19 has returned to the starting position, the two strips 175 and 177 are transported over a line distance of the image to be formed. When the rotation of the gear wheel 63 is continued, the pin 115 is in engagement with the Maltese cross 117, as a result of which a step rotation of the gear wheel 119 is obtained (cf. FIG. 5). By way of the gear wheels 93 and 91, the gear wheel 19 now also rotates through one step. The gear wheel 95 belongs to a first gear wheel train, to which further belong the gear wheels 99, 103, 105 and 107 so that the transport roller 65 also rotates through one step. The gear wheel 95 at the same time belongs to a second gear wheel train, with which the take-up roller 191 for the colour transfer strip 177 is driven in a stepwise manner. For this purpose, there is arranged between the gear wheel 95 and the gear wheel 109 the frictional ring 111, which exerts a driving torque on the gear wheel 109. As appears from FIG. 15, the gear wheel 109 is in engagement with the gear wheel 169, which in turn is in engagement with the gear wheel 171 secured to the take-up roller 191. Consequently, the gear wheels 95, 109, 169 and 171 belong to the second gear wheel train. The frictional force between the strips 175 and 177 is larger than the frictional force between the colour transfer strip 177 and the printing elements 20. Furthermore, the ratio between the transmissions of the first and the second gear wheel train is chosen so that even at the beginning of winding the colour transfer strip 177 onto the take-up roller 191, its circumferential speed would slightly exceed the circumferential speed of the disks 324 and 326 if no slip should occur between the frictional ring 111 and the gear wheel 109. Actually, slip occurs between the frictional ring 111 and the gear wheel 109 because the diameter over which the frictional ring 111 engages the gear wheel 109 is smaller than the diameter over which the frictional ring 111 engages the gear wheel 95. The speed of slip of the frictional ring 111 over the gear wheel 109 increases as the diameter of the take-up roller 191 increases. Thus, it is ensured that per unit time equal lengths of the two strips 175 and 177 are transported along the printing elements 20 with an increasing diameter of the take-up roller 191. The frictional force of the frictional ring 111 on the gear wheel 109 is always such that the colour transfer strip 177 is kept taut between the transport roller 65 and the take-up roller 191. Due to the fact that the colour transfer strip 177 is kept taut, it is also ensured that the strips 175 and 177 are torn apart in case adherence occurs between the strips (175, 177) during the process of applying and drying the wax on the data strip 175. After the data strip 175 has been transported along the pressure elements 20 over a distance which is equal to the distance between two successive rows of printed points in the body colour yellow, the pin 115 no longer engages the Maltese cross 117 and the transport of the two strips (175, 177) has stopped. The next line of points in the colour yellow is now printed with continued rotation of the gear wheel 63. The shape of the comb 147 is such that the printing head 19 starts with a next forward translation just after the transport of the strips 175 and 177 has stopped. In the manner described, all the following lines of image points are printed in the colour yellow. Printing takes place solely during the forward translation of the printing head 19. By way of example, in a manner similar to that shown in British Patent Application No. 2100673, it is mentioned that data strip 175 could be provided at the beginning of each image field with a marker (not shown) which could be detected by a suitable first detector (not shown). The colour transfer strip 177 could be provided at the beginning of each yellow field of wax with a marker (not shown) which could be detected by a suitable second detector (not shown). At the beginning of the printing process, both markers were consequently located opposite the respective detectors. After all the lines of image points have been printed in the colour yellow, the two strips (175, 177) are transported further over a given distance. This distance is chosen so that it is ensured that the next field of wax in the second body colour, which as those skilled in the art will understand could be magenta, is located opposite the printing elements 20. The motor 61 is stopped automatically after transport of the two strips (175, 177) over the said distance. Therefore, it is not necessary for markers to be detected. Subsequently, by means of the motor 243, the function disk 235 is driven in a direction opposite to that for activating the pressure plate 251. The pins 231 and 247 extend in the grooves 233 and 245, respectively. Since the pin 247 follows the groove 245, the pin 247 traverses a track having a radius of gradually decreasing value so that the pressure plate 251 is lifted. The lever 249 then rotates about the shaft 193. However, the pin 231 follows a track having a constant radius because the beginning of the groove 233 is circular. The pin 231 therefore continues to occupy a fixed position so that the lever 229 and the shaft 193 are not rotated either. The motor 243 is stopped before the pin 231 leaves the circular part of the groove 233. Consequently, the positioning of the transport roller 65, the cassette 17 and the pressure rollers 225 and 227 is maintained. Subsequently, the gear wheel 63 is driven by the motor 61 in a direction opposite to the direction of rotation corresponding to the transport of both strips 175 and 177 over the image line distance as already described. This means that the spring 129 will move over the comb 143 so that the coupling halves 123 and 127 are disengaged and the cam disk 59 is stationary. The printing head 19 is consequently not driven in this stage. The transport of the colour transfer strip 177 is blocked by the leaf spring 297 which is in engagement with the milled wheel 303 (cf. FIGS. 14 and 15). As a result, the frictional ring 111 will slip over the now stationary gear wheel 109. The data strip 175 is transported in a number of steps intermittently back to the initial position which could be recognized by means of the first detector. This detector could supply a stopping signal for the motor 61 at the instant at which the aforementioned marker on the data strip 175 is detected. Since the field of wax of the second body colour magenta of the colour transfer strip 177 is already located below the printing elements 20, printing of the image points in the colour magenta can now be started after the pressure plate 251 has first been pressed by means of the function disk 235 against the printing head 19. The image points in the colour magenta are now printed over the already printed image points in the colour yellow. After all the image points in the colour magenta have been printed, the image points in the third body colour, which as those skilled in the art will understand could be cyan, are printed in an analogous manner. As the case may be, further image points in the colour black could also be printed. The different colour shades of the image points in which wax of the three different body colours is present are obtained by varying the quantities of wax that are remolten. This may be effected in a usual manner by supplying to the printing elements 20 control signals, whose pulse width is modulated. After the complete image has been printed, a next image can be printed on the data carrier or strip 175. Furthermore, the part of the data carrier or strip 175 with the already printed image can be torn off. The length of the two strips (175, 177) is such that a number of images can be printed successively. If desired, the cassette 17 may be removed from the printer 1.

As appears from FIG. 7, the function disk 235 is provided with a third groove 325, which forms a guide for a third follower pin 327 which is secured to a lever 330 which is journalled in the sidewall 7 so as to be rotatable about a shaft 329. The groove 325 is located on the side of the function disk 235 facing the sidewall 7. The lever 330 has secured to it an ejector pin 331 which is guided in a slot 333 in the side-wall 7. When the cassette 17 is inserted, the ejector pin 331 engages the front side of the cassette 17 (not shown in the Figures). Consequently, when the function disk 235 is rotated, the cassette 17 with the ejection pin 331 can be moved over a given length out of the printer 1 by means of the lever 330. The cassette 17 can then be removed by hand. To the sidewall 7 of the printer 1 are secured two micro-switches 335 and 337, switching cams 339 and 341 of which engage a comb 343 on the function disk 235. The switches 335 and 337 serve to limit the rotations of the function disk 235 in both directions of rotation.

Whilst maintaining the principle of a pivotable transport roller 65 for the transport of the data strip 175 described hereinbefore with reference to a particular embodiment of the printer 1, a number of alternatives are possible. In fact, the printer 1 and cassette 17 described are multifunctional. This means that the printer 1 and the cassette 17 are suitable both for black-and-white printing and for colour printing. In the case of black-and-white printing, there are two possibilities, i.e.:

printing with a combination of a data strip and a transfer strip only comprising the colour black, printing solely with a data strip.

In both cases, it is no longer necessary to transport the data strip back. If solely a data strip is used, the cassette of course only comprises a data strip. The latter may consist of heat-sensitive paper if the printing head 19 comprises thermal printing elements 20, as in the present case. However, the printing head 19 may be of a quite different type. For example, suitable printing heads are electrostatic printing heads, printing heads with beater elements, such as printing pins, printing heads operating with ink-drop generators, magnetic printing heads and optical printing heads operating with a photo-sensitive layer on the data strip. Such printing heads and the data strips used therewith are known per se. Alternatively, use may be made of a data strip comprising a heat-sensitive layer in which a colour turn is brought about by thermal printing elements. The transport of the data strip and/or transfer strip may be intermittent, as described, as well as continuous. The printing head may also be fixedly arranged. When thermal printing elements are used, a comparatively large number of comparatively small printing elements are then required.

Although the printer has been described with reference to a printing principle, according to which the points of different body colours are printed over each other, other configurations of the points in different body colours may also be chosen. By way of example, the points may be printed both in a triangular configuration and in a line configuration. Such configurations are known per se. It is also known that the base colours may be formed on the colour transfer strip in rectangular fields, in parallel successive narrow strips or in a triangular configuration. As those skilled in the art will understand the transport roller can be locked in the first final position (whilst the cassette is removed) in different ways, for example by means of an electromagnet activated by a switch upon insertion of the cassette. Due to the construction with a pivotable transport roller, a printer of comparatively small constructional height is obtained.

What is claimed is:

1. A printer having a guide for an insertable cassette, in which is provided a receipt strip displaceable with respect to a printing head, the cassette being provided with at least one entrance window for transport members of the said strip, characterized in that a lock releasable by an initial translation of the cassette in the printer releases a transport roller which is pivotable about a fixed shaft, is cylindrical and performs after a further translation of the cassette a pivotal movement into a cassette window on a first cassette side and consequently gets into pressure contact with the printing head on a second cassette side located opposite the first cassette side, the receipt strip being clamped during printing between the transport roller and the printing head.

2. A printer as claimed in claim 1, characterized in that the cassette is provided with a receipt strip and a transfer strip, which, when the transport roller is pivoted, are both clamped between the transport roller and the printing head, while an electric motor arranged in the printer is coupled via a first gear wheel train to the transport roller for the transport of the receipt strip and is coupled via a second gear wheel train to a take-up roller for the transport of the transfer strip arranged in the cassette.

3. A printer as claimed in claim 2, characterized in that a gear wheel belonging to the first gear wheel train is coupled by means of a frictional coupling to a gear wheel belonging to the second gear wheel train.

4. A printer as claimed in claim 1, characterized in that the printer is provided with a rotatable function disk having first and second guide grooves, the first groove being in engagement with a first follower pin which is coupled to a first lever system for pivoting a pair of pressure rollers against the transport roller and for positioning the cassette with respect to the printing head, while the second groove is in engagement with a second follower pin which is coupled to a second lever system for pivoting a pressure plate engaging the printing head with resilient force.

5. A printer as claimed in claim 1, characterized in that said printer includes first and second gear wheel trains coupled by means of a stepping mechanism to an electric motor.

6. A printer as claimed in claim 5, characterized in that the cassette is provided with a receipt strip and a transfer strip, which, when the transport roller is pivoted, are both clamped between the transport roller and the printing head, while said electric motor arranged in the printer is coupled via said first gear wheel train to the transport roller for the transport of the receipt strip and is coupled via said second gear wheel train to a take-up roller for the transport of the transfer strip arranged in the cassette, and in that the stepping mechanism comprises a first gear wheel which can be continuously rotated by the electric motor and a stepwise rotatable second gear wheel, while the continuously rotatable first gear wheel can be coupled by means of a unidirectional coupling to and can be disengaged from a cam disk which is in engagement with a cam follower secured to the printing head, the stepwise rotatable second gear wheel being in engagement with a gear wheel which belongs both to the first and to the second gear wheel train.

7. A cassette for a printer as claimed in claim 2, characterized in that the cassette has a supply roller for a transfer strip rotatable about a first shaft and a take-up roller for the transfer strip rotatable about a second shaft parallel to the first shaft, the take-up roller being provided with a driving member which can be coupled to an external motor drive arranged in the printer.

8. A cassette as claimed in claim 7, characterized in that the first shaft is provided with a frictional coupling, which during printing, when the first shaft and the second shaft are rotated in a direction corresponding to the transport direction of the receipt strip or the transfer strip, exerts a continous frictional force on the first shaft and after printing, when the second shaft is stationary, causes the first shaft to be transiently rotated in a direction opposite to the direction of rotation of the first shaft during printing.

9. A cassette as claimed in claim 8, characterized in that the frictional coupling comprises a helical spring which is slipped over the first shaft and has a first end bearing on a wall in the cassette and a free second end, a first part of the helical spring engaging on its inner side a part of the first shaft having a comparatively large diameter, while a second part of the helical spring is arranged so as to be free from a part of the first shaft having a comparatively small diameter.

10. A cassette as claimed in claim 7, characterized in that the cassette is provided with a brake for the receipt strip which during printing is switched off and exerts before and after printing in the switched-on condition a braking force on the receipt strip.

11. A printer having a guide for an insertable cassette, in which is located a data carrier to be printed, characterized in that the printer comprises a lock which is releasable by a force parallel to the guiding direction of the cassette and which upon release releases a transport roller which is pivotable about a fixed shaft, is cylindrical and is rotable about a cylinder axis, this cylinder axis being displaced in a direction parallel to itself when the transport roller is pivoted from a first final position to a second final position, said transport roller being located in a position opposite a printing head in the printer in said second final position.

* * * * *